US009924791B2

(12) United States Patent
Bortolato et al.

(10) Patent No.: US 9,924,791 B2
(45) Date of Patent: Mar. 27, 2018

(54) EXPANDABLE MOTORIZED TABLE

(71) Applicant: D. & C.—DESIGN AND CONSULTING S.R.L., Noale (IT)

(72) Inventors: Lorenzo Bortolato, Roana (IT); Paolo Dal Fabbro, Venice Mestre (IT); Denis Duregon, Noale (IT); Michele Lugato, Spinea (IT)

(73) Assignee: 10 I CUBE S.R.L., Noale (IT)

( * ) Notice: Subject to any disclaimer, the term of this patent is extended or adjusted under 35 U.S.C. 154(b) by 0 days.

(21) Appl. No.: 15/321,747

(22) PCT Filed: Jul. 6, 2015

(86) PCT No.: PCT/IB2015/055099
§ 371 (c)(1),
(2) Date: Dec. 23, 2016

(87) PCT Pub. No.: WO2016/005881
PCT Pub. Date: Jan. 14, 2016

(65) Prior Publication Data

US 2017/0127820 A1 May 11, 2017

(30) Foreign Application Priority Data

Jul. 8, 2014 (IT) ..... VE2014A0041

(51) Int. Cl.
*A47B 13/00* (2006.01)
*A47B 1/05* (2006.01)
(Continued)

(52) U.S. Cl.
CPC ..... *A47B 1/05* (2013.01); *A47B 13/088* (2013.01); *A47B 2001/053* (2013.01); *A47B 2013/024* (2013.01); *A47B 2200/0021* (2013.01)

(58) Field of Classification Search
CPC ... A47B 1/05; A47B 13/088; A47B 2001/053; A47B 2013/024; A47B 2200/0021;
(Continued)

(56) References Cited

U.S. PATENT DOCUMENTS 351,101 A * 10/1886 Fauber ..... A47B 1/056 108/66
687,712 A * 12/1901 D'Apery ..... A47B 1/08 108/83
(Continued)

FOREIGN PATENT DOCUMENTS

| | | | |
|---|---|---|---|
| DE | 20016966 | | 1/2001 |
| FR | 2044481 | * | 2/1971 |
| GB | 2396552 | * | 6/2004 |

*Primary Examiner* — Janet M Wilkens
(74) *Attorney, Agent, or Firm* — Themis Law

(57) ABSTRACT

A motorized expandable table includes a vertical column upperly supporting a table top. In a first configuration the table top is defined only by main portions and in a second configuration only by the main portions and by additional portions, which include outer additional portions and a central additional portion. The additional portions are entirely covered by and hidden below the main portions in the first configuration, and the outer additional portions are disposed radially about a support associated with the column and present an inclination different from the adjacent outer additional portions. A driving system is associated with the main portions, the support, the outer additional portions and the central additional portion for their movement, to enable the table to pass between the first and the second configuration. An electronic control and management is provided for the driving system.

15 Claims, 5 Drawing Sheets

(51) Int. Cl.
*A47B 13/08* (2006.01)
*A47B 13/02* (2006.01)

(58) Field of Classification Search
CPC ..... A47B 2001/035; A47B 1/02; A47B 1/056; A47B 1/08; A47B 1/03
USPC ... 108/66, 70–73, 76, 81, 82, 166, 167, 169, 108/171, 17, 20, 83–86, 67, 68, 137, 87, 108/89; 248/602, 346.06, 346.07
See application file for complete search history.

(56) References Cited

U.S. PATENT DOCUMENTS 821,955 A * 5/1906 Nash ..... A47B 1/056 108/66
829,439 A * 8/1906 Simone ..... A47B 1/056 108/66
838,671 A * 12/1906 Turner ..... A47B 1/056 108/66
993,539 A * 5/1911 Munz ..... A47B 1/056 108/66
1,139,564 A * 5/1915 Oberg et al. ..... A47B 1/056 108/66
1,384,924 A * 7/1921 Schultz ..... A01B 15/10 172/664
1,547,685 A * 7/1925 Rhodes ..... A47B 13/088 108/66
2,162,298 A * 6/1939 Dailey ..... A47B 3/00 108/128
2,703,740 A * 3/1955 Cochard ..... A47B 1/056 108/66
4,201,816 A * 5/1980 Bertelsen ..... A47B 1/05 108/66
5,156,095 A 10/1992 Hansbaek
5,237,937 A * 8/1993 Peltier ..... A47B 13/088 108/66
6,009,814 A * 1/2000 Rossi ..... A47B 1/05 108/66
8,997,659 B2 * 4/2015 Leduc ..... A47B 9/00 108/68
2004/0194672 A1 * 10/2004 Conley ..... A47B 1/02 108/83
2006/0075940 A1 * 4/2006 Dodge ..... A47B 1/03 108/86

* cited by examiner

EXPANDABLE MOTORIZED TABLE

The present invention relates to an expandable motorized table.

Expandable tables are tables able to assume two or more configurations. In particular, they are arranged such as to easily pass from a configuration of lesser size (defined hereinafter as "closed" or "first"), in which the table top occupies a smaller area, to a configuration of greater size (defined hereinafter as "open" or "second"), in which the table top occupies a larger area.

More particularly, the present invention relates to an expandable table of the type comprising a support column, to the top of which a support plate is connected consisting both of main portions, i.e. of portions which alone, when in the drawn-together condition, define the table top when in its closed configuration, and of additional portions, i.e. portions which when in the closed configuration are hidden by the main portions, while when in the open configuration are inserted between these such as to increase the area of the table top.

Traditional tables of this type present a limited expansion capacity, defined as the ratio between the area of the table top when in the open configuration and the area of the table top when in the closed configuration. In particular, this limitation is caused mainly by mechanical and geometrical restrictions which mean that, when in the closed configuration, the additional portions are always disposed parallel below the table top defined by the main portions.

An expandable table of this type is described for example in GB 2396552; in particular, when in the closed configuration, the additional portions of this table are disposed in a perfectly horizontal position below the table top defined by the main portions, this considerably limiting its expansion capacity.

U.S. Pat. No. 5,156,095 describes instead an expandable table in which, when in the closed configuration, the additional portions are disposed in a nearly vertical position inside the support column. However, this solution involves limitations dictated by the geometrical dimensions of the portions themselves, therefore resulting in a series of practical constructional limits. In this respect, the additional portions cannot have a width exceeding that of the central support column, which must certainly be less than the table width when in the closed configuration; moreover, the length of the additional portions certainly cannot exceed the height of said column.

Motorized expandable tables are also known, i.e., tables in which passage between the closed configuration and the open configuration is achieved by suitably controlled motors. However, in these known motorized tables, the individual parts are made to move simultaneously by drives which act on complex multiple linkages, i.e. each able to move several parts simultaneously. It follows that each of the parts to be moved requires a multiplication of the forces required for executing the individual movements, with inevitable difficulty in discriminating the resistant forces due to contact with persons or objects, from the forces due instead to the friction of the linkages, and hence with difficulty in implementing the controls required for the safety locks.

An object of the invention is to eliminate these drawbacks by providing a motorized expandable table with high expansion capacity, i.e. with a high ratio between the area of the table top when in the open configuration and that when in the closed configuration.

Another object of the invention is to provide a table which enables better control of the safety manoeuvres, i.e. those manoeuvres to be carried out in case of contact with persons and objects during the steps involved in passage of the table from one configuration to the other.

Another object of the invention is to provide a table in which the table top can comprise portions of virtually any shape and dimensions.

Another object of the invention is to provide a table which is completely automated and is also operable remotely.

Another object of the invention is to provide a table which is completely self-contained and houses in its interior all the components required for its operation.

Another object of the invention is to provide a table in which the control, diagnosis and maintenance can also be implemented remotely.

Another object of the invention is to provide a table which is of simple, rapid and low-cost production.

These objects and others which will be apparent from the ensuing description are attained, according to the invention, by a motorized expandable table in accordance with claim 1.

BRIEF DESCRIPTION OF THE DRAWINGS

The present invention is further clarified hereinafter with reference to the accompanying drawings in which.

DETAILED DESCRIPTION

Figure 1:
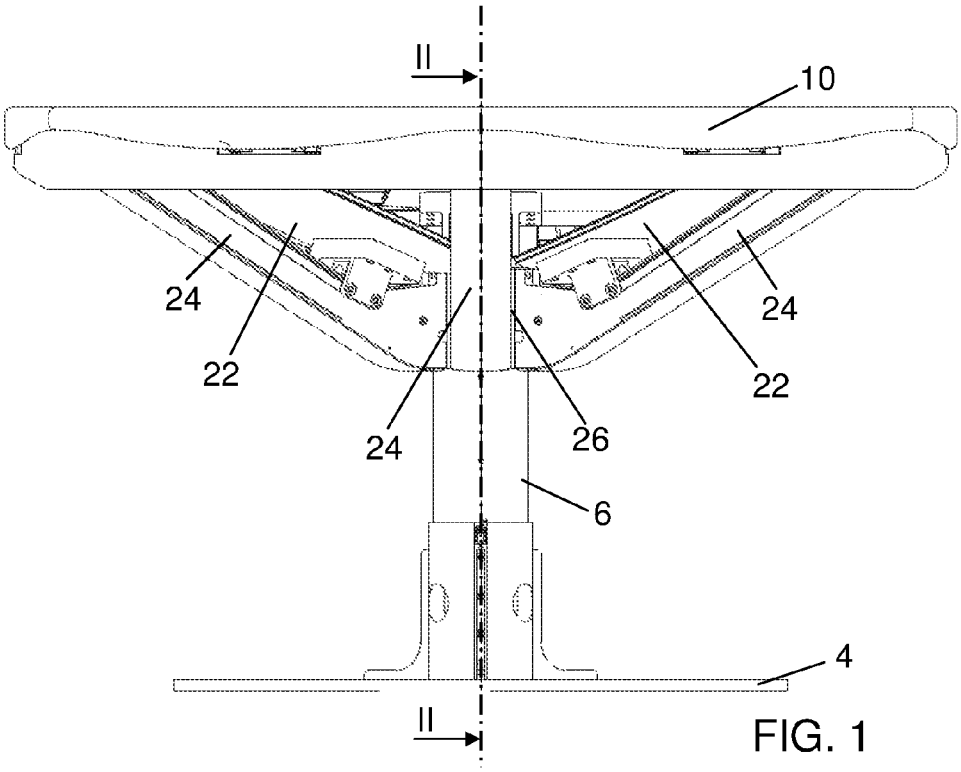
FIG. 1 is a lateral view of a motorized expandable table according to the invention when in the closed configuration.

As can be seen from the figures, the improved motorized expandable table 2 according to the invention comprises a base 4 and a central column 6 acting as the load-bearing column.

Table main portions 10 are fixed by a support plate to the upper end of the column 6, these portions, when in the drawn-together condition, defining by themselves the table top when in its closed configuration. In the embodiment shown in Figures from 1 to 10, the main portions 10 are six in number, all having the same shape, which can be defined approximately as circular sectors with the two radial sides curved. However, according to the invention, the main portions can also be of an even number different from six.

The lower surface of each main portion 10 is connected to a respective carriage 12 slidable along radial linear guides 14 associated with the support plate. In particular, the guides 14 enable the main portions 10 to move in a radial direction between an inner position, in which said portions are in mutual contact (i.e. when the table is in its closed configuration and the table top presents its minimum area), and an outer position, in which said portions are spaced apart (i.e. when the table is in its open configuration and the table top reaches its maximum area).

Advantageously, the edges of the radial sides of the portions 10 are provided with slots and are suitably shaped to enable said portions to be mutually engaged by an insertion fit and with precise coplanarity of the portions themselves.

The main portions 10 are associated with driving means 16, 18 which cause said portions to move between said inner position and said outer position.

Preferably, each of the main portions 10 is provided with its own drive linkage 16 connected to its own electrical operating motor 18. For example, the drive linkage 16 comprises a threaded bar connected to the electric motor 18 and engaged by a lead nut connected to the main portion itself. The position of the main portions 10 is controlled by the encoders of the corresponding electric motors 18, or, advantageously, said portions 10 can be provided with electrical limit sensors, for example one to sense the position of the outer end of travel limit and one for the inner end, to feed a signal to a control and management unit for the table.

In addition to the main portions 10, the table 2 comprises an equal number of additional portions, i.e. of portions which are added to the main portions to define the table top when in its open configuration. In particular, the additional portions comprise outer additional portions 22 intended to be interposed between the main portions 10, and a central additional portion 40.

The outer additional portions 22 are supported by respective arms 24, which extend radially (i.e. radial to the central column 6) and are hinged to an annular support 26 positioned below the support plate and movable axially along the column 6.

The annular support 26 is associated with driving means 27, 29 for its axial movement along the column 6. In greater detail, the driving means comprise a linkage, indicated overall by 29, provided with its own motor 27 suitably controlled by an encoder integrated into the motor, or by limit sensors associated with the annular support 26, to feed a signal to the table control and management unit.

When the table is in its closed configuration, the outer additional portions 22 are positioned below the main portions 10 and are covered by these; in passing from the closed configuration to the open configuration, they are moved in a radially outward and upward direction to become inserted between the main portions 10 when these are spaced apart.

In greater detail, each outer additional portion 22 is associated lowerly with a respective carriage 28 slidable along guides 30 provided on the arms 24. The guides 30 can be suitably shaped such that the additional portions 22 define radial movement trajectories which are not perfectly rectilinear, i.e. defining at least one curved section. Advantageously, the outer additional portions 22 can rotate about the axis defined by the respective guides 30 and, in general, can be driven in roto-translation in order to optimize, when the table 2 is in its closed configuration, their compaction below the main portions 10.

When in the closed configuration, the additional portions 22 are disposed radially about the column 6 such as to be substantially mutually superposed. In particular, for this purpose, the portions 22 are positioned at different heights in the vertical plane with, in greater detail, each additional portion 22 presenting an inclination to the vertical axis defined by said column 6, which is different from the adjacent inclination (see FIGS. 2, 4 and 7). In particular, each arm 24 supporting the corresponding additional portion 22 defines with the axis of the column 6 an angle with its inclination different from the angle defined by the arms 24 supporting adjacent additional portions. This enables the additional portions 22, when in the table closed configuration, to be hidden below the main portions 10 and be disposed with different inclinations alternately, in order to optimize the space and prevent mutual interferences.

Essentially, when in the closed configuration, each additional portion 22 defines, with the column 6, angles having a different inclination to the additional portions, angles which however are all substantially less than 90°.

Figure 4:
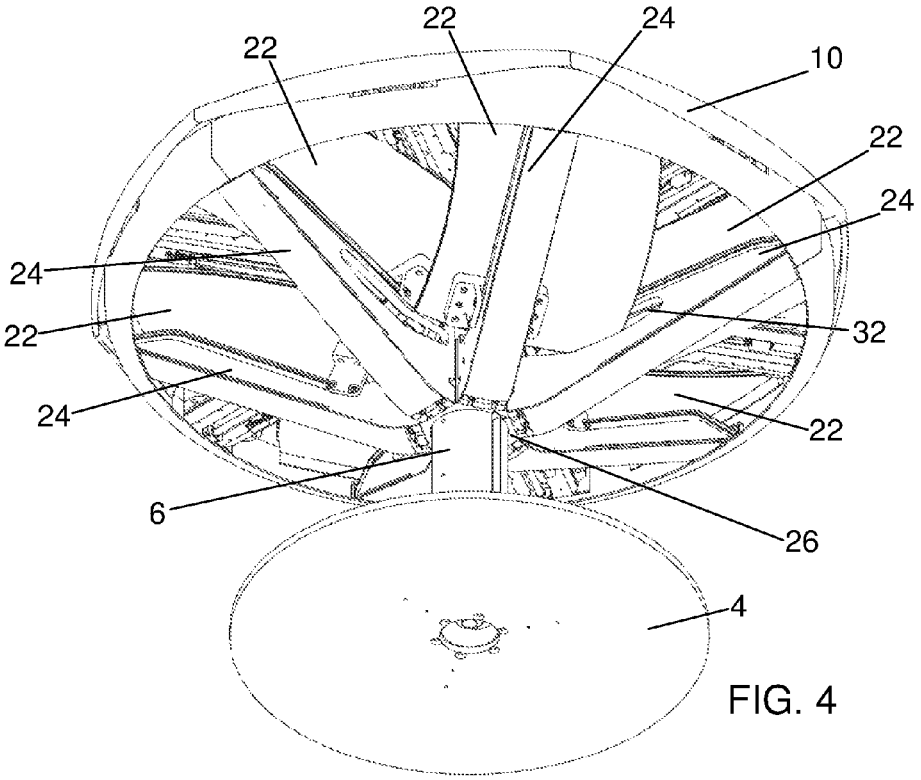
FIG. 4 is a perspective view thereof from below when in the closed configuration.

Advantageously the arms 24 or parts thereof are of box construction and present, in their lateral walls, slots 32 intended for the partial insertion of outer additional portions 22 when the table is in the closed configuration (see FIG. 4).

The outer additional portions 22 are associated with driving means 34, 36 for causing the portions to move and enable the table 2 to pass between the closed configuration and open configuration.

Preferably, each of the outer additional portions 22 is provided with its own drive linkage, indicated overall by 34 and consisting for example of a lead nut and a threaded bar. Each drive linkage 34 is connected to its own electric operating motor 36, housed in seats provided in the arms 24. Advantageously, said motors are mounted on a plate 38 which itself can undergo small rotations about the respective arm 24 and hence enable the guide 30 to undergo small oscillations during the travel of the additional portion 22.

The central additional portion 40 is connected to the column 6 and is intended to be joined to the main portions 10 and to the outer additional portions 22 to define the table top when in the open configuration.

The central additional portion 40 is associated with driving means 42, 43 which cause said portion to move and enable the table 2 to pass between the closed configuration and open configuration. In greater detail, the driving means comprise a linkage, indicated overall by 43, connected to a motor 42 which moves the central additional portion 40 while making it always remain parallel to the table top defined by the main portions 10.

The central additional portion 40 is preferably of polygonal shape and, with the table in closed configuration, is positioned below the main portions 10 and is hidden by these, whereas with the table in open configuration it is positioned at the table centre, at the same level as the main portions 10 and the outer additional portions 22.

The position of both the outer additional portions 22 and the central additional portion 40 is controlled by the encoders of the corresponding electric motors 36 and 42 or, advantageously, said additional portions are provided with limit sensors which feed a signal to the table control and management unit.

Advantageously, all the motors 18, 27, 36 and 42 are self-contained and individually controllable independently of each other by suitable electronic means commanded by the table control and management unit. In greater detail, the motors 18, 27, 36 and 42 used in the table 2 according to the invention are servomotors with capacity for controlling the drive torque in terms of velocity and position.

The means for commanding the table to pass from the closed configuration to the open configuration, and vice versa, can be integrated into the table itself, in an easily accessible position, and/or be external to the table. In particular, said command means comprise suitable traditional user interfaces, such as pushbuttons, remote controls, touch-screen, keypads or smart phones and PCs.

Passage of the table according to the invention from the first configuration, i.e. the closed configuration, to the second configuration, i.e. the open configuration, is apparent from the description.

Figure 5:
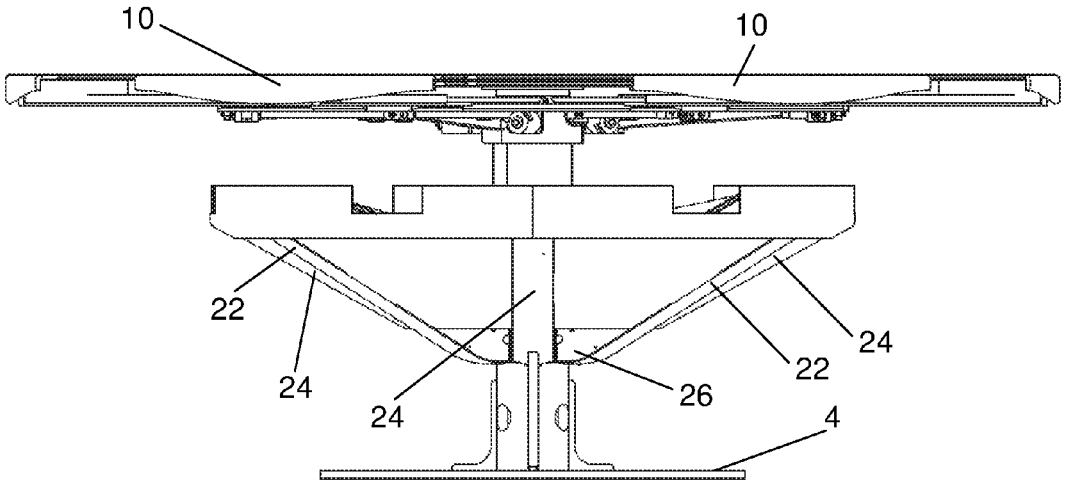
FIG. 5 is a lateral view thereof when in the partially open configuration.

In particular, when the opening command is fed, the annular support 26 and the corresponding outer additional portions 22 connected to it are moved downwards along the column 6 (see FIG. 5).

Figure 6:
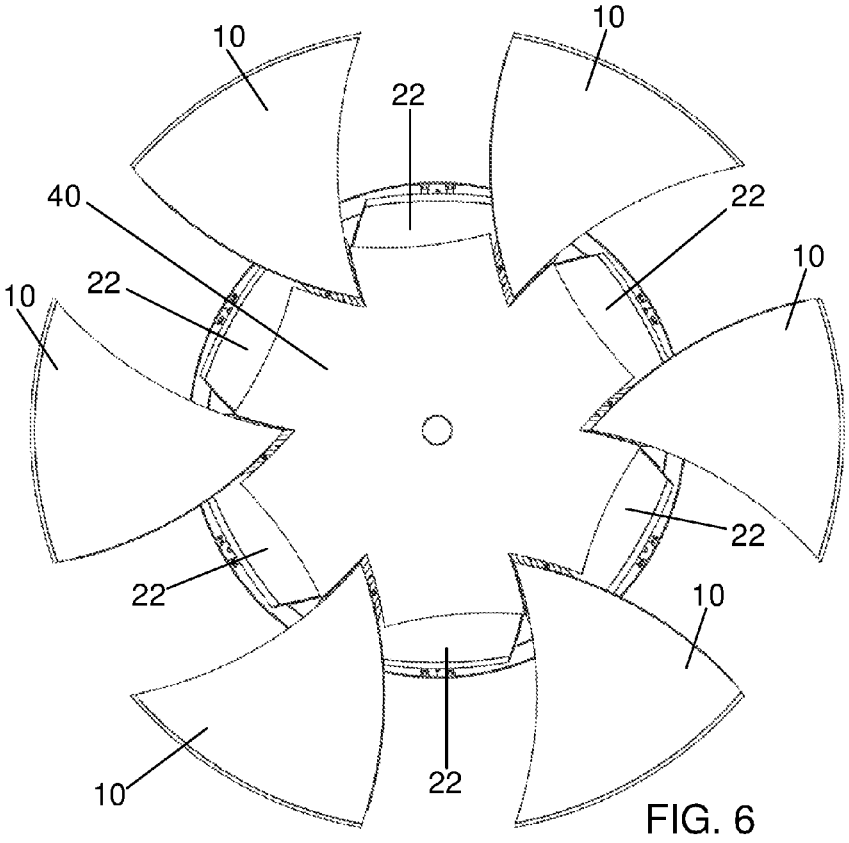
FIG. 6 is a plan view thereof in the configuration of FIG. 5.
Figure 7:
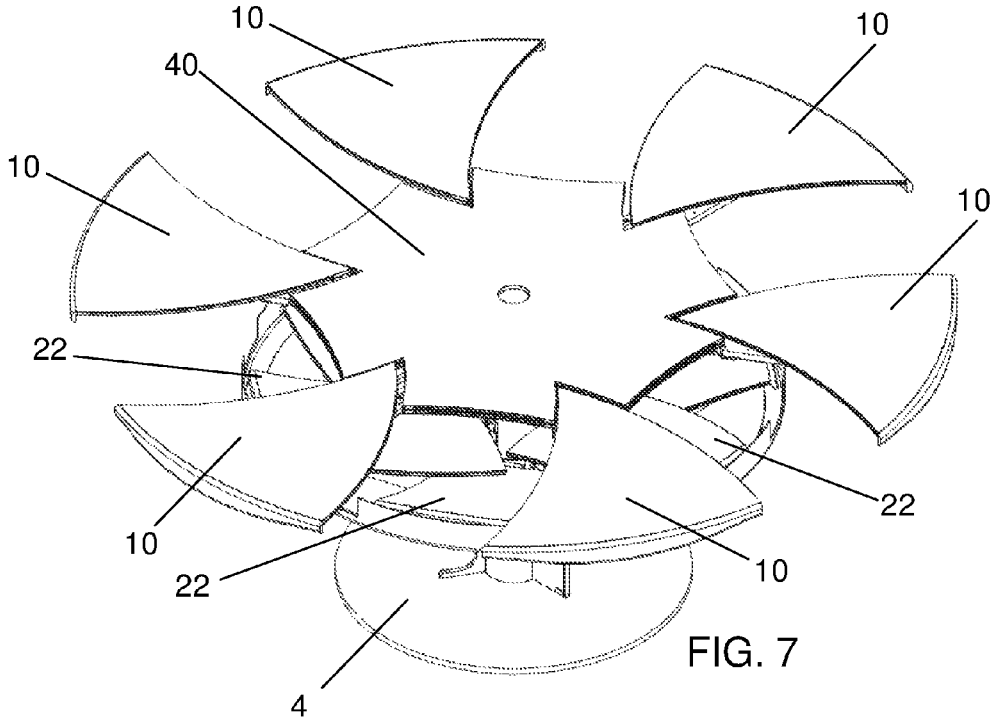
FIG. 7 is a perspective view thereof from above when in the configuration of FIG. 5.

The main portions 10 are then moved radially away from the centre and, when they have reached their end of travel position, the central additional portion 40 is raised to become positioned coplanar with said main portions (see FIGS. 6 and 7).

Figure 8:
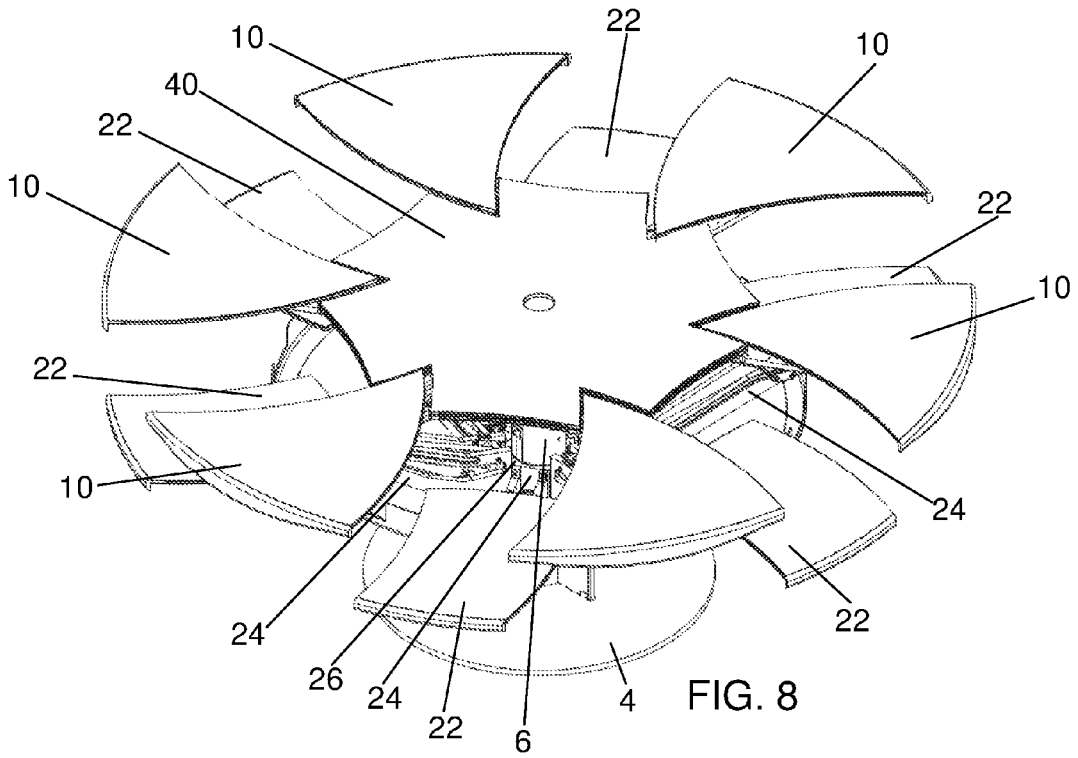
FIG. 8 shows it in the same view as FIG. 7 in a subsequent partially open configuration.
Figure 9:
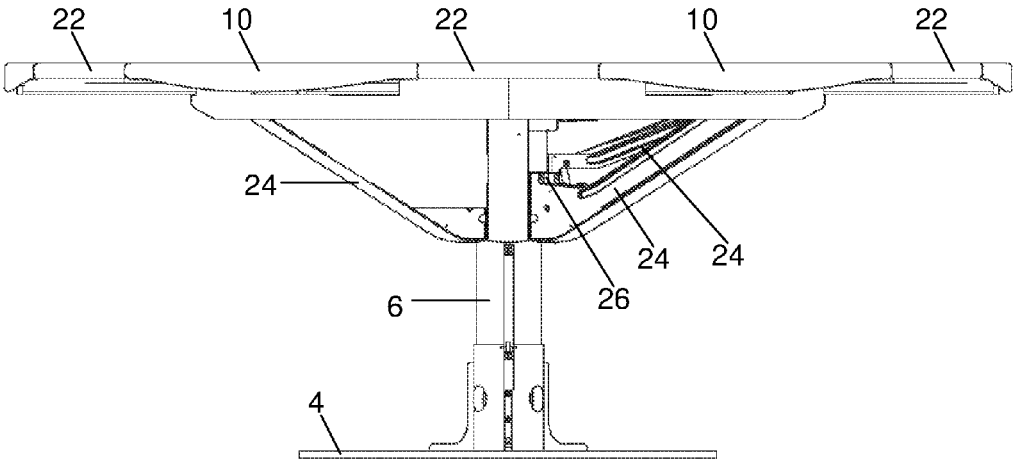
FIG. 9 shows it in the same view as FIG. 5 when in the totally open configuration.

At this point the outer additional portions 22 begin to move radially outwards (see FIG. 8); in particular the upper portions move first, i.e. those associated with arms 24 of greater inclination, followed by the lower portions, i.e. those associated with arms 24 of lesser inclination, When the outer additional portions 22 have also reached their end of travel position, the annular support 26 is made to translate upwards such as to bring the outer additional portions 22 into the same plane as the main portions 10 and as the central additional portion 40.

Figure 10:
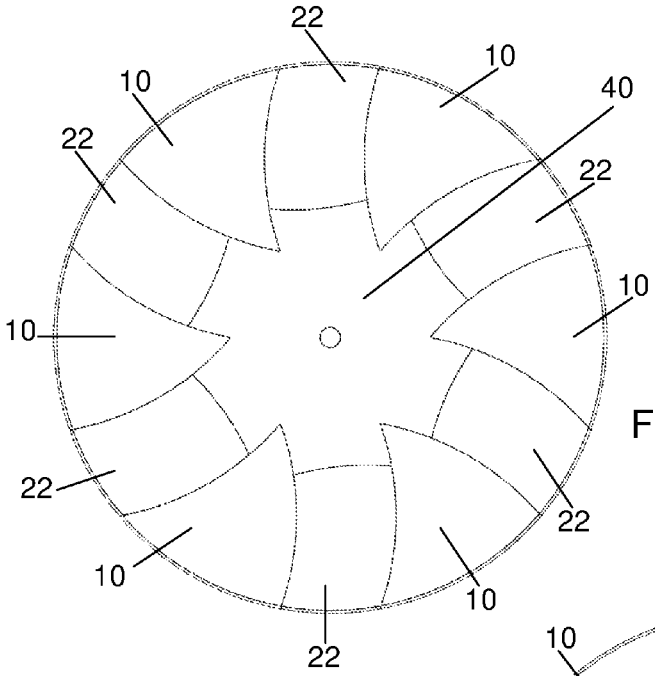
FIG. 10 is a plan view thereof when in the configuration of FIG. 9.

Finally, the main portions 10 and the outer additional portions 22 are moved towards the centre such as to enable their edges and the edges of the central additional portion 40 to insertion fit together, such as to define a continuous table top (see FIG. 10).

Essentially, when the table is in the closed configuration, the surface of the table top is defined by the sum of the surfaces of just the main portions 10, whereas when the table is in the open configuration, the surface of the table top is defined by the sum of the main portions 10 and of the outer additional portions 22 and of the central portion 40.

The control and management unit of the table 2, this unit not being shown in the drawings, comprises an electronic control centre (for example a PLC) which can be housed in a suitable seat defined in the table itself, for example in the lower part of the central column 6, or can also be external to the table and communicate with the integrated electronic components of the table itself by suitable means, preferably of wireless type.

Moreover, the control and management unit can be configured such as to enable it to be connected to the internet, so that diagnosis, control and maintenance of the table 2 can also be done remotely; appropriately, if the remote diagnosis requires the execution of particular movements, these latter are possible only in the presence of suitable safety expedients.

Appropriately, the sequence and the movement velocities of the various table portions can be easily set, by acting on the electronic control and management unit, which then commands the electronic control components of the corresponding motors.

Advantageously, the control and management unit can be set and programmed by acting directly on the unit interface, and/or by external computers which are connected to the unit when required.

Advantageously, means suitably arranged to provide specific functionalities can be associated with the upper, i.e. visible, surface of the main portions 10, of the outer additional portions 22, and of the central portion 40. In particularly, these means comprise display means (such as flat screen LCDs), and/or user interface means (such as touch-screens), and/or also photovoltaic cells for powering the electronic devices provided in the table, and/or electrical energy storage means.

Advantageously, the table according to the invention comprises means which make it completely self-sufficient from its electric powering viewpoint. In particular, the table houses in its interior electrical energy storage means, for example a battery, which can be recharged by said photovoltaic cells positioned on the visible upper surface of the table, and/or by the traditional electric mains via a suitable electronic device which transforms the electric mains voltage into a suitably controlled voltage suitable for recharging said storage means.

Advantageously, the table 2 comprises a compartment, preferably defined in the lower part of the column 6, able to house all, or part, of the electronic and electric components required for operating the table. In particular, said compartment can house the electrical energy storage means and/or the control and management unit.

Preferably, said electronic and electric components required for operating the table are of very small dimensions, so as to be able to be housed in the interior of the compartment defined in the column 6. In greater detail, these components have dimensions such as to be able to be contained within a compartment having dimensions substantially within the range 15-30 $dm^3$.

Figure 2:
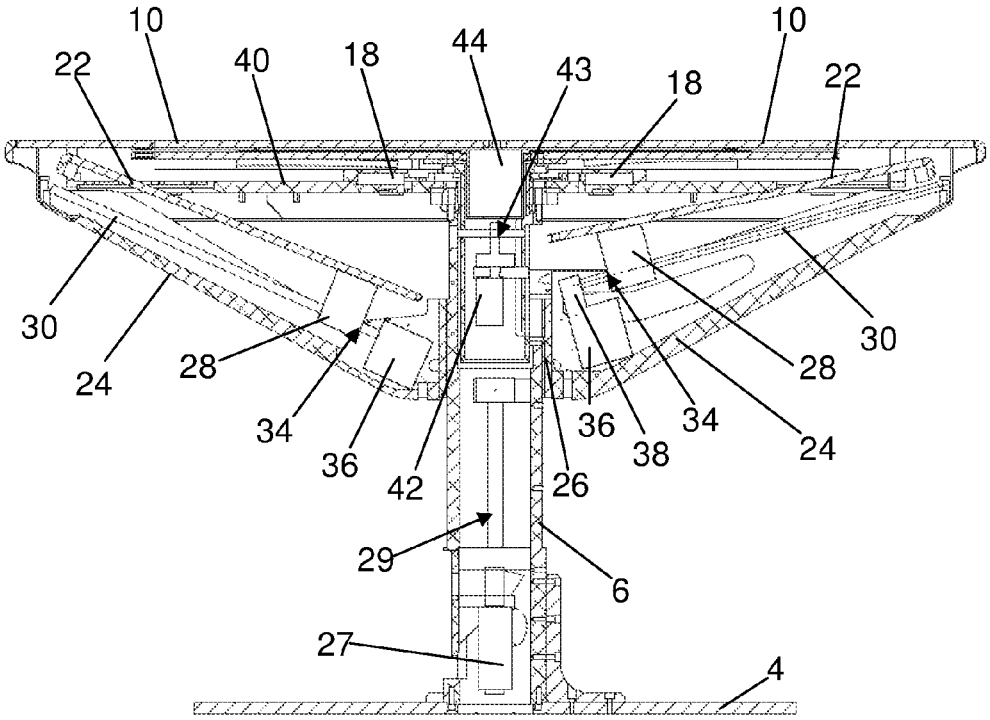
FIG. 2 is a vertical section therethrough on the line II-II of FIG. 1.
Figure 3:
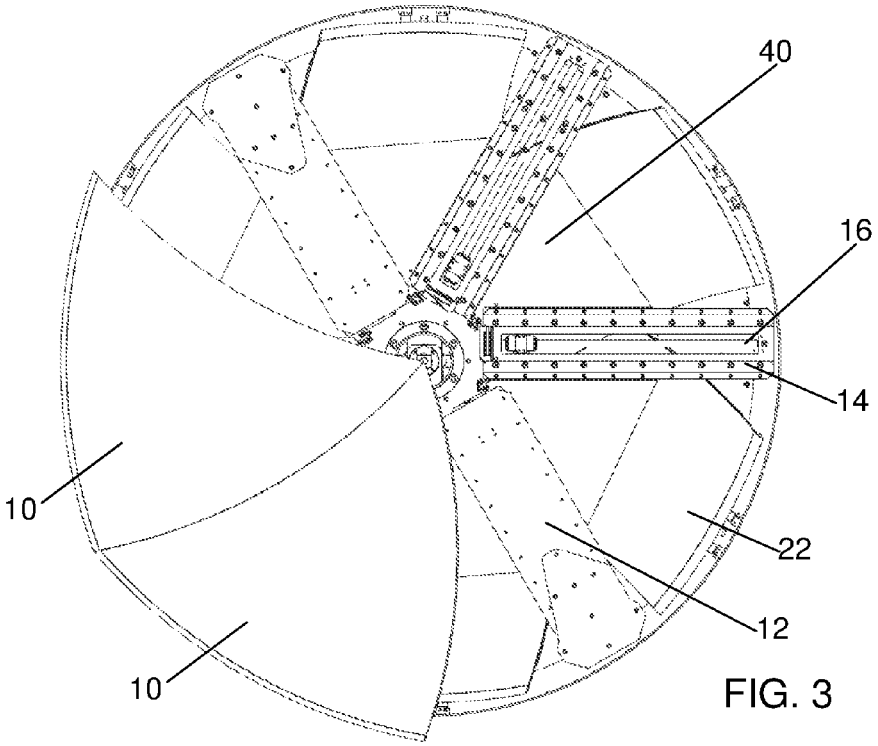
FIG. 3 is a plan view thereof when in the closed configuration, without any of the main portions which define the table top.

As can be seen from FIG. 2, the central additional portion 40 can comprise a compartment or an internal seat 44 for housing objects. In addition, the central additional portion 40 can be associated with driving means arranged to enable said portion to be rotated about its vertical axis, or to enable it to be inclined laterally.

The table 2 according to the invention is adapted to be used not only as a dining table, but also for room decoration and as a display stand.

Figure 11:
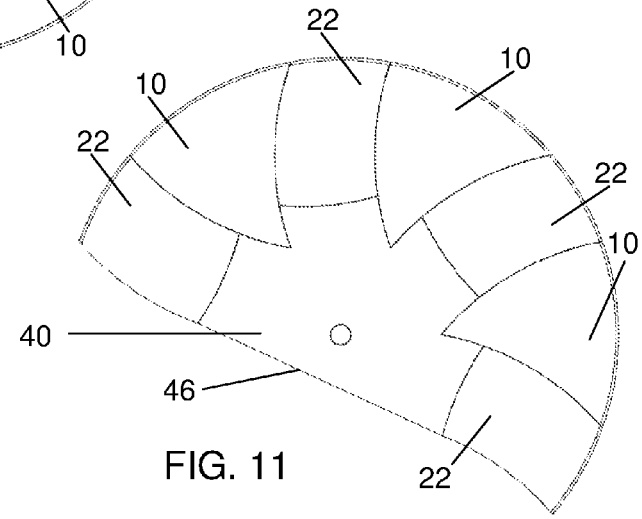
FIG. 11 shows it in the same view as FIG. 10 but as an embodiment with a different form of the table top.

The top of the table 2 can present, either in open configuration or in closed configuration, not only the circular shape represented in the embodiment shown in Figures from 1 to 10, but also an elliptical form or a form presenting at least one rectilinear or substantially rectilinear side 46 (see FIG. 11), such that the table can be rested more easily against a wall.

From the aforegoing it is apparent that the table according to the invention is much more advantageous than traditional tables of the same type, in that:

- it is of simple construction,
- the fact that when in the closed configuration the additional portions are disposed at different levels to, and at different angles to, the plane defined by the main portions means that the ratio between the table surface when in the open configuration and the table surface when in the closed configuration can be increased; in greater detail, in the expandable table according to GB 2396552 the expansion capacity (i.e. the ratio between the table top surface when in the open configuration and the table top surface when in the closed configuration) is substantially equal to 1.7, whereas in the expandable table according to the present invention, the expansion capacity is equal to or greater than 2.2,
- the fact that the main portions 10 and additional portions 22 and 40 can be moved automatically and independently enables sequential angular and overlying positioning of the various portions defining the table top to be achieved, hence increasing the performance achievable in terms of expansion capacity; in particular, this also enables portions of different shape and dimensions to be used, it enables the movement of all portions to be remotely controlled automatically and independently, the fact that the individual portions can be operated individually by electronically controlled servomotors enable the torques required to overcome the friction of the drive mechanisms to be determined and hence controlled; in particular, this enables safety actions to be immediately implemented should the motor torques vary unexpectedly for any reason during manoeuvres.

The invention claimed is:

1. A motorized expandable table (2), comprising:

at least one vertical column (6) upperly supporting a table top, wherein, in a first configuration, the table top is defined only by main portions (10), and in a second configuration, the table top is defined only by said main portions (10) and by additional portions (22, 40), wherein the additional portions comprise outer additional portions (22) and a central additional portion (40), said additional portions (22, 40) being entirely covered by and hidden below said main portions (10) when in said first configuration, and wherein said outer additional portions (22) are disposed radially about a support (26) associated with said vertical column (6), each outer additional portion (22) being disposed, when in said first configuration, to present an inclination, said inclination being defined with reference to said vertical column (6), said inclination being different from inclinations of adjacent outer additional portions (22);

a driving system (16, 18, 27, 29, 34, 36, 42, 43) associated with said main portions (10), with said support (26), with said outer additional portions (22) and with said central additional portion (40) for their movement, to enable the motorized expandable table to pass between said first and said second configuration; and an electronic control and management system for said driving system (18, 27, 36, 42).

2. The motorized expandable table as claimed in claim 1, wherein said driving system comprises first driving devices (16, 18) for radial movement of said main portions (10), a second driving device (27) for axially moving said support (26) along the vertical column (6), third driving devices (34, 36) for the radial movement of said outer additional portions (22), and a fourth driving device (42) for axial movement of said central additional portion (40).

3. The motorized expandable table as claimed in claim 1, wherein said driving system comprises linkages (16, 29, 34, 43) operated by an electric motor (18, 27, 36, 42).

4. The motorized expandable table as claimed in claim 1, wherein each of said main portions (10) and of said outer additional portions (22) is provided with its own driving devices (16, 18, 34, 36).

5. The motorized expandable table as claimed in claim 1, wherein said driving system comprises motors (18, 27, 36, 42) that are self-contained and are electronically controlled, independently of each other, by said electronic control and management system.

6. The motorized expandable table as claimed in claim 5, wherein said electronic control and management system comprises an electronic control center housed within a seat defined in the motorized expandable table.

7. The motorized expandable table as claimed in claim 5, wherein said electronic control and management system comprises an electronic control center housed external to the motorized expandable table and communicating with motors (18, 27, 36, 42) of said driving system.

8. The motorized expandable table as claimed in claim 1, further comprising one or more of a display, a user interface, or photovoltaic cells associated with a visible surface of the main portions (10), of the outer additional portions (22), or the central additional portion (40).

9. The motorized expandable table as claimed in claim 1, further comprising, for causing the motorized expandable table to pass between said first configuration and said second configuration, devices which are integrated into the motorized expandable table in an easily accessible position, or are external to the table.

10. The motorized expandable table as claimed in claim 1, further comprising a sensor monitoring a position of movement of said main portions (10), of said support (26), of said outer additional portions (22), and of the central additional portion (40).

11. The motorized expandable table as claimed in claim 1, wherein each outer additional portion (22) is associated lowerly with a respective carriage (28) slidable along guides (30) provided on arms (24) fixed about said support (26) associated with the vertical column (6).

12. The motorized expandable table as claimed in claim 1, wherein the driving system of said outer additional portions (22) is configured such that, as the motorized expandable table passes between said first configuration and said second configuration, the outer additional portions (22) move radially to said support (26).

13. The motorized expandable table as claimed in claim 1, wherein the driving system of said outer additional portions (22) is configured such that, as the table passes between said first configuration and said second configuration, the outer additional portions (22) move radially to said support (26) to define trajectories with at least one rectilinear section and at least one curved section.

14. The motorized expandable table as claimed in claim 1, wherein the driving system of said outer additional portions (22) is configured to enable said outer additional portions (22) to oscillate about a substantially radial axis.

15. The motorized expandable table as claimed in claim 1, wherein, when in said second configuration, the table top presents a circular form, an elliptical form, or a form presenting at least one substantially rectilinear side (46).

* * * * *